US005350350A

United States Patent [19]

Maccalli

[11] Patent Number: 5,350,350

[45] Date of Patent: Sep. 27, 1994

[54] APPARATUS FOR FORMING AND APPLYING HANDLES TO BAGS

[75] Inventor: Giacomo Maccalli, Lodi, Italy

[73] Assignee: Curioni Sun S.r.l., Teramo, Italy

[21] Appl. No.: 90,155

[22] PCT Filed: Dec. 6, 1991

[86] PCT No.: PCT/IT91/00107

§ 371 Date: Jul. 23, 1993

§ 102(e) Date: Jul. 23, 1993

[87] PCT Pub. No.: WO93/10968

PCT Pub. Date: Jun. 10, 1993

[51] Int. Cl.[5] ..... B31B 37/62; B31B 37/86; B31B 1/86

[52] U.S. Cl. ..... 493/221; 493/226; 156/547; 156/552

[58] Field of Search ..... 493/88, 210, 221, 226; 156/547, 552

[56] References Cited

U.S. PATENT DOCUMENTS

| | | | |
|---|---|---|---|
| 2,334,256 | 11/1943 | Eaton | 493/226 |
| 2,844,075 | 7/1958 | Davis et al. | 493/221 |
| 3,101,033 | 8/1963 | Bonsor | 493/221 |
| 3,202,064 | 8/1965 | Kennedy | 493/226 |
| 3,334,550 | 8/1967 | Craig | 493/226 |
| 3,439,591 | 4/1969 | Class | 493/221 |
| 3,481,256 | 12/1969 | Hayes et al. | 493/221 |
| 3,494,264 | 2/1970 | Class | 493/226 |
| 3,611,883 | 10/1971 | Grob | 493/226 |
| 3,835,756 | 9/1974 | Bosse | 493/226 |
| 4,133,252 | 1/1979 | Eckstein et al. | 493/226 |
| 4,284,454 | 8/1981 | Joa | 156/552 |

FOREIGN PATENT DOCUMENTS

| | | |
|---|---|---|
| 1611654 | 1/1971 | Fed. Rep. of Germany . |
| 2096103 | 2/1972 | France . |
| 881426 | 11/1961 | United Kingdom . |
| 1141744 | 1/1969 | United Kingdom . |

*Primary Examiner*—William E. Terrell

*Attorney, Agent, or Firm*—Panitch Schwarze Jacobs & Nadel

[57] ABSTRACT

An apparatus for carrying rope handles for paper bags to a paper bag forming station is disclosed. The rope handles are supplied to the bags at the entrance of the forming station before forming the bags. The apparatus includes a first and a second plurality of gripping devices (36) for gripping the handles (34) fed by a handle forming station. The first and second plurality of gripping devices (36) are arranged substantially side by side at the entrance of the bag forming station towards which they move. At least one pair of units (94, 98, 104) for taking the handles (34) is located at the entrance of the bag forming station. Also provided are members (70, 78, 88, 92) to control the inhibition of the gripping devices (36) and the actuation of the units (94, 98, 104) for taking the handles (34) from the gripping devices (36) so that the handles (34) are fed to the paper bag forming station.

17 Claims, 7 Drawing Sheets

APPARATUS FOR FORMING AND APPLYING HANDLES TO BAGS

The present invention relates to an apparatus for carrying rope handles for paper bags to a forming station thereof wherein said handles are applied to the bags at the entrance of said station before forming the bags.

It is known that rope handles for paper bags, made either of synthetic or vegetable material, consist of a portion of rope, essentially U-bent, whose ends are bound between two rectangular paper sheets, overlapped and sticked to each other.

Said handles are usually automatically applied inside the machine which manufactures paper bags before the formation thereof, i.e. when the paper strip for forming the bag is still spread out.

Generally apparatuses for making paper bags with rope handles comprise, essentially, a station for forming said handles continuously feeding a station for carrying them at the entrance of the bag forming station. A suitable means, to be dealt with hereinafter, causes the handles, particularly the rectangular sheets holding the rope ends, to be sticked on the still spread out strip to be used later for the paper bag formation.

Traditional apparatuses, whose basic structure has been briefly described hereinabove, have remarkable drawbacks deriving either from their considerable encumbrance that makes difficult and sometimes impossible the installation at premises of users having little room available, or from the way in which such apparatuses apply handles to the paper strip, such an application resulting difficult and complex to be accomplished and substantially scarcely reliable.

The first of the above mentioned drawbacks mainly derives from the fact that the glue that will allow the binding of handles to the strip from which bags will be obtained, is applied on the latter in predetermined areas corresponding to those for the binding of handles. This operation is accomplished by suitable rotating rollers, one of which applies the glue on the strip when required, while the other actuates only a backing action. As the handles to be applied are two for each bag, there will be necessary to provide two units of rollers for smearing glue on the strip, arranged substantially side by side, each unit being provided with its own control and actuation means. The presence of these units makes considerable the machine encumbrance taking also into account that the strip slides between them shifting upward until a not negligible height which depends on the total height of the glue applying rollers. Thus there becomes necessary the realization of a suitable casing in the upper part of which all the different parts are arranged which accomplish the binding of handles to the strip. These latter parts must be actuated in perfect synchronism with the feeding of strip to apply the handles exactly in the pre-glued areas. It is clear that in case of adjustement of said parts, for instance due to a variation of the distance between the handles deriving from a different width of the bag, or for maintenance works, the personnel must reach the upper part of said casing which must be therefore provided with ladders.

Besides the hereinabove described drawback of the encumbrance in height, the known apparatus has also a considerable transversal encumbrance as the overlapped and sticked paper strips on which the ends are fixed of the substantially U-bent rope from which handles will be later obtained, are supplied transversally to the strip from which bags will be obtained, from both sides of the strip. It is clear that all apparatuses accomplishing the formation of said strips from which handles will be obtained add a considerable side encumbrance to the bag forming station.

The application of glue on the strip from which bags will be obtained involves problems as such an application must be accomplished at well defined time intervals, i.e. it must be "in phase" depending on the speed of the strip from which bags will be obtained, and depending on the "pitch", i.e. the length of the bag. Thus the cylinders applying glue on the strip must work in perfect synchronism with the means controlling the feeding of the strip and the means for applying handles.

The application of glue on the strip from which bags will be obtained is at present accomplished according to two different techniques which however do not give particularly reliable results.

A first technique consists in using electronically controlled spraying devices, but such devices do not assure a regular glue smearing and thus it is not certain that the handle will remain perfectly adherent to the strip A second technique provides the use of a mechanical glueing device but such a device requires long times for its setting to approach a correct working, particularly due to the choice of the gear ratios of the means controlling its actuation and the correct synchronization with the strip feeding.

It has been now devised, and forms the object of the present invention, an apparatus of the aforesaid type which allows to eliminate all the drawbacks of the traditional apparatuses.

Therefore one of the main objects of the present invention is to provide an apparatus by which the carrying of the handles towards the bag forming station is accomplished by using means whose motion takes place substantially at man height thus reducing the apparatus encumbrance in height.

Another object of the present invention is to provide an apparatus by which the handle glueing onto the strip from which bags will be obtained is extremely reliable mainly because glue is applied on the handles and not on said strip.

A further object of this invention is to provide an apparatus in which the handle glueing takes place while the handles are carried towards the bag forming station with extreme simplification of the apparatus.

Still another object of this invention is to provide an apparatus in which the handles, once they have glue on a face thereof, are simply transferred onto the strip from which bags will be obtained and applied thereon thus eliminating the problems of synchronization present in the traditional apparatuses.

These and further objects as well as advantages of the apparatus according to the present invention will be clear from the following detailed description of a non-limiting embodiment thereof, made with reference to the attached drawings in which.

Figure 1:
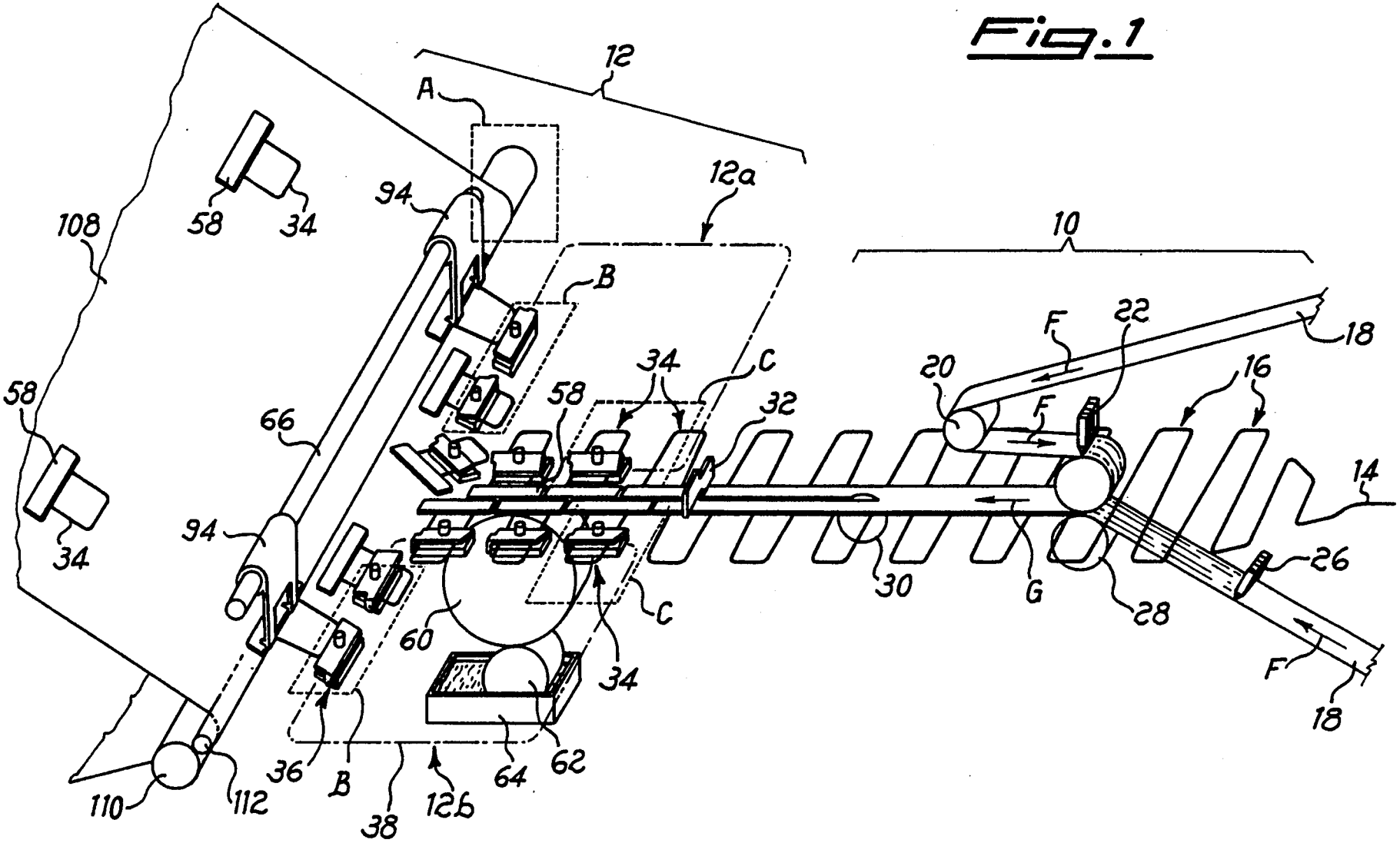
FIG. 1 is a schematic perspective view showing the apparatus according to the present invention, there also being represented the handle forming station.

With reference at first to FIG. 1 it is described as a whole an apparatus for the forming of rope handles and for their application to a paper strip from which bags will be obtained, while taking into account that the present invention relates to the part of said apparatus regarding the feed of handles to the bag forming station and their application to the paper strip from which the bags will be obtained.

With reference to said figure it is referenced as a whole by 10 the rope handle forming station, downstream of which there is arranged, referenced as a whole by 12, the apparatus according to the present invention as hereinabove defined.

As it is known a rope handle for paper bags essentially consists of a portion of rope having a certain length, substantially U-bent whose ends are bound by two rectangular paper sheets overlapped and slicked to each other, forming the part of handle to be slicked on the bag.

In the station designated 10 in FIG. 1 said handles are formed as hereinafter described.

From a first feeding station neither represented nor described as it is per se known, a rope 14, is fed made of synthetic or vegetable material, which, by means of known devices not represented, is caused to assume a substantially zig-zag shape essentially consisting of successive portions 16 which are substantially U-shaped. Each portion 16 is opposedly folded with respect to the following one to obtain, with respect to a median longitudinal line cutting on the zig-zag bent rope, two pluralities of handles which will be fed to two pluralities of means for carrying and applying handles as hereinafter described.

From a second feeding station also neither represented nor described, as per se known, two paper strips 18 are fed having quite reduced width and moving according to the direction of arrows F in FIG. 1.

The paper strip 18 coming from above is caused to pass at first on a transmission roller 20 and, after a glue layer has been applied thereon by a known glueing device 22, is caused to pass on a pressing roller 24 which is clockwise rotatably supported by the apparatus casing.

The strip 18 coming from below, after a glue layer has been applied thereon by a known glueing device 26, is caused to pass on a pressing roller 28 arranged under the pressing roller 24 and cooperating therewith. In particular the pressing roller 28 is counter-clockwise rotatably supported by the apparatus casing.

Thanks to pressing rollers 24 and 28 the two paper strips 18 are sticked to each other, thus binding between them a piece of the rope portions 16.

The assembly formed by strips 18 and portions 16 now forming a whole, is fed into the apparatus according to the arrow G of FIG. 1.

The rope handles are now formed by means of two cutting operations, lengthwise and crosswise respectively as hereinafter explained.

The first cut to be carried out is the lengthwise one and, to such aim, a circular rotating blade 30 is used.

The crosswise cut is carried out thereafter and, to such aim, a plane blade 32 is used rotating on a median axis substantially horizontal and provided, on its opposite sides, with two cutting edges having length essentially equal to a half of its total length, said edges being provided on both sides of the median line along which the lengthwise cut has been carried out.

The obtained rope handles designated 34, are now fed to the station for carrying and feeding them to the bag forming station.

As it is noted referring again to FIG. 1, said station for carrying and feeding rope handles 34, for the sake of brevity hereinafter simply defined handles, consists of two substantially identical parts, designated 12*a* and 12*b*, symmetrically arranged with respect to the feed direction of handles 34. Clearly only one of said two parts is described and in particular the part 12*b* will be described as, on the side of its location, a station controlling means is arranged that will be also described.

Referring now also to FIGS. 2 to 8 at first FIGS. 2 to 5 will be considered showing means by virtue of which the handles 34, one at a time, are gripped and held by means carrying them until the entrance of the bag forming station.

In the part 12*b* a plurality of pliers 36 is provided for carrying handles 34 which are supported in any known way by a chain 38 visible in FIG. 2 to 8 and represented by the dash-and-dot line in FIG. 1 having a substantially rectangular development with a side arranged in front of the entrance of the bag forming station.

Each of the carrying pliers 36 essentially consists of a lower jaw 40 pivoted through a pin 42 on an element on which there is also pivoted, again through pin 42, an upper jaw 44, which is separated by the lower jaw 40 thanks to the hereinafter described means that allows the shutting of plier 36 when the latter moves away from this means.

The upper jaw 44 is upperly provided with a roller 46 rotatably supported by a pin 48 integral with the upper side of the upper jaw 44.

The means controlling the opening and allowing plier 36 to close is arranged in the zone indicated by section C in FIG. 1 and is shown in detail in FIGS. 2 to 5.

Figure 2:
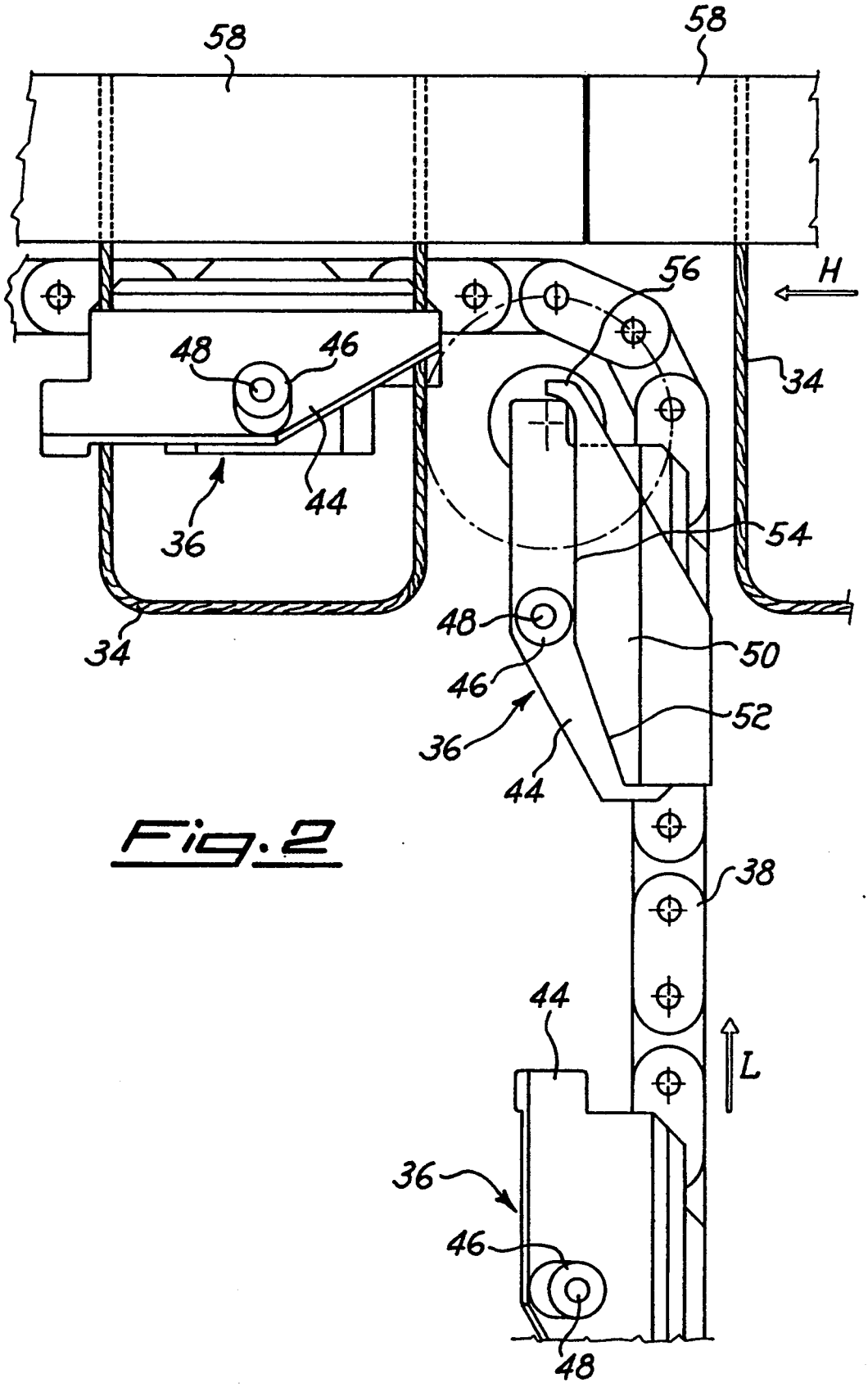
FIG. 2 is a plan view showing a mechanism for controlling the handle carrying means, that is not represented in FIG. 1 but is arranged in the positions indicated by C-areas on the same figure.
Figure 3:
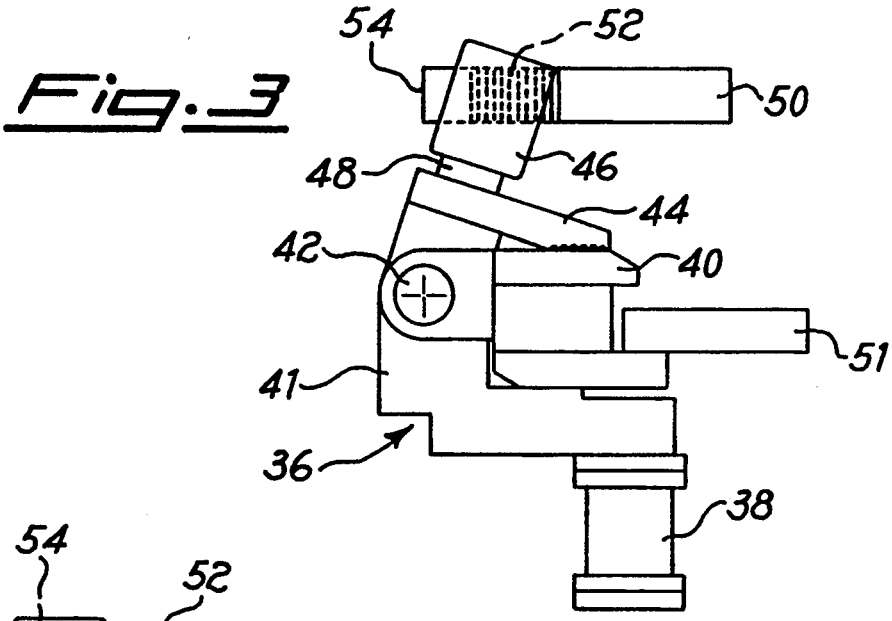
FIGS. 3, 4 and 5 are side views showing the mechanism of FIG. 2 in its different operating steps.
Figure 4:
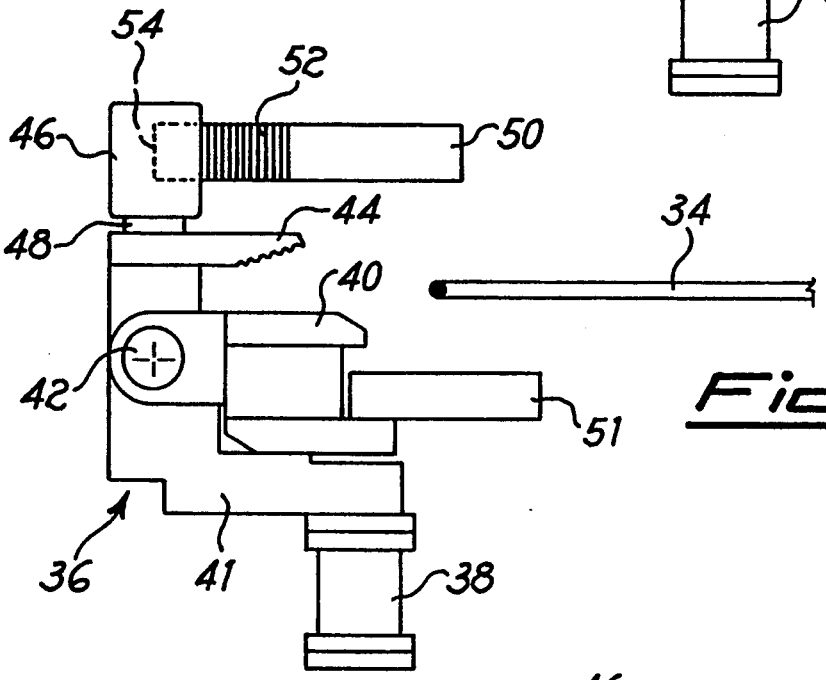

Said means essentially consists of a cam shaped section 50 integral with the apparatus casing and arranged at a higher position than the feeding path of pliers 36 at the arrival zone of handles 34 which, in FIG. 2, are fed in the direction of the arrow H.

As there is seen in particular in FIG. 2, cam section 50 has a first inclined plane side 52 which extends in a second side substantially parallel to the feeding direction of pliers 36. The roller 46 of plier 36 successively engages with both sides 52, 54 of cam section 50 and in particular the engaging of roller 46 with inclined plane side 52 of cam 50 drives the opening of plier 36 as there is seen in particular in FIGS. 3 and 4. While jaw 44 rotates upward, jaw 40 is held by a clamp 51 allowing the opening of the plier which is kept opened as long as roller 46 is engaged with side 54 until, as it is noted in particular from FIG. 2, said roller 46 engages with the terminal part 56, substantially bent of a right angle, of cam section 50. In this condition plier 36, although staying opened, is rotated of 90° just by virtue of the 90° bending of chain 38 which advances in the direction of the arrow L of FIG. 2 and in this condition plier 36 receives a handle 34.

Figure 5:
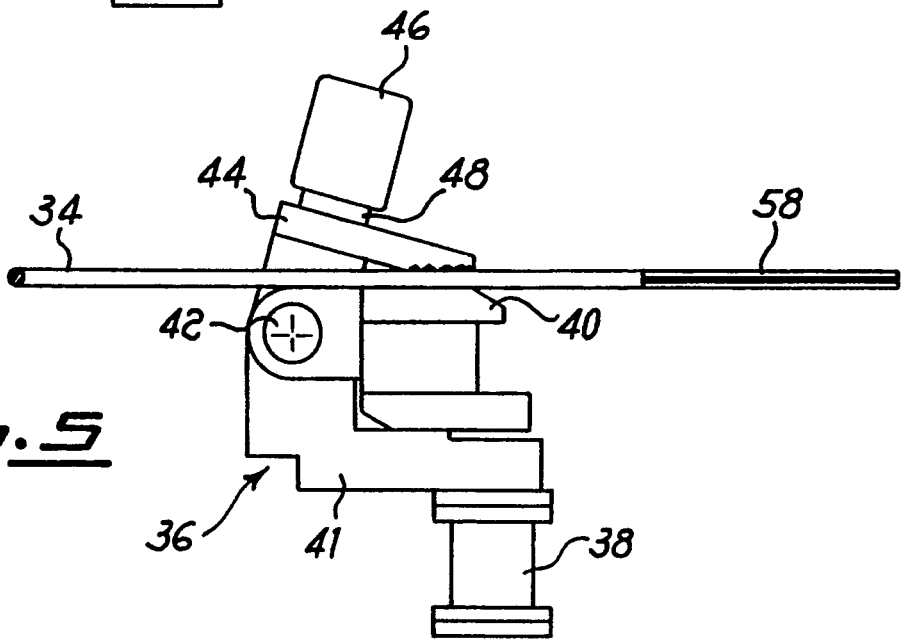

From this condition, once both branches of handle 34 are placed between jaws 40 and 44 of plier 36, the latter leaves cam section 50 and, thanks to the action of a non represented spring arranged on pin 42, e.g. a helical spring, plier 36 is closed as shown in FIG. 5 holding handle 34, e.g. as shown in FIG. 2 for plier 36 in the upper part of this drawing.

As handles 34 are fed one at a time to the part **12*b* of the apparatus and pliers 36 advance in synchronism with such feeding, the pliers will keep a handle 34** at a time carrying it towards the successive stations of the apparatus.

The operating step immediately following the keeping of a handle 34 consists in the smearing of a layer of adhesive material on the lower side of sheets 58 holding the ends of the U-bent rope of a handle 34. This step is visible in particular in FIG. 1 wherein there is seen that, underneath the feeding path of sheets 58, a roller 60 is arranged, rotatably supported in any known way by the apparatus casing, which lowerly engages with the second roller 62 rotatably supported in any not represented known way by the apparatus casing. It is partially dipped into a tray 64 containing the adhesive material. This is transferred from the second roller 62 to the first roller 60 which smears said material on the lower side of sheets 58.

The pliers 36, and the handles 34 therewith, continue in advancing towards the bag forming station until they are further rotated of 90° so that sheets 58 are placed in front of the entrance of the bag forming station. This further rotation is obtained thanks again to the change of direction, substantially of 90°, of chain 38.

The successive operating steps of taking handles 34 from pliers 36 and their application on the paper strip from which bags will be obtained take place while pliers 36 advance along the rectilinear path parallel to the entrance side of the bag forming station.

Now reference will be made particularly to FIGS. 6 to 8 to describe the means which accomplishes the opening of pliers 36 and the carrying of handles 34, one in the part **12*b* and one in the part 12*a***, to the bag forming station and their application on the strip from which bags are obtained.

The means which opens pliers 36 is located, in FIG. 1, in the positions indicated by the sections B, while the means which carries handles 34 to the bag forming station is visible in FIG. 1 and the relative means for its operation is Located, in FIG. 1, in the position indicated by section A.

Figure 6:
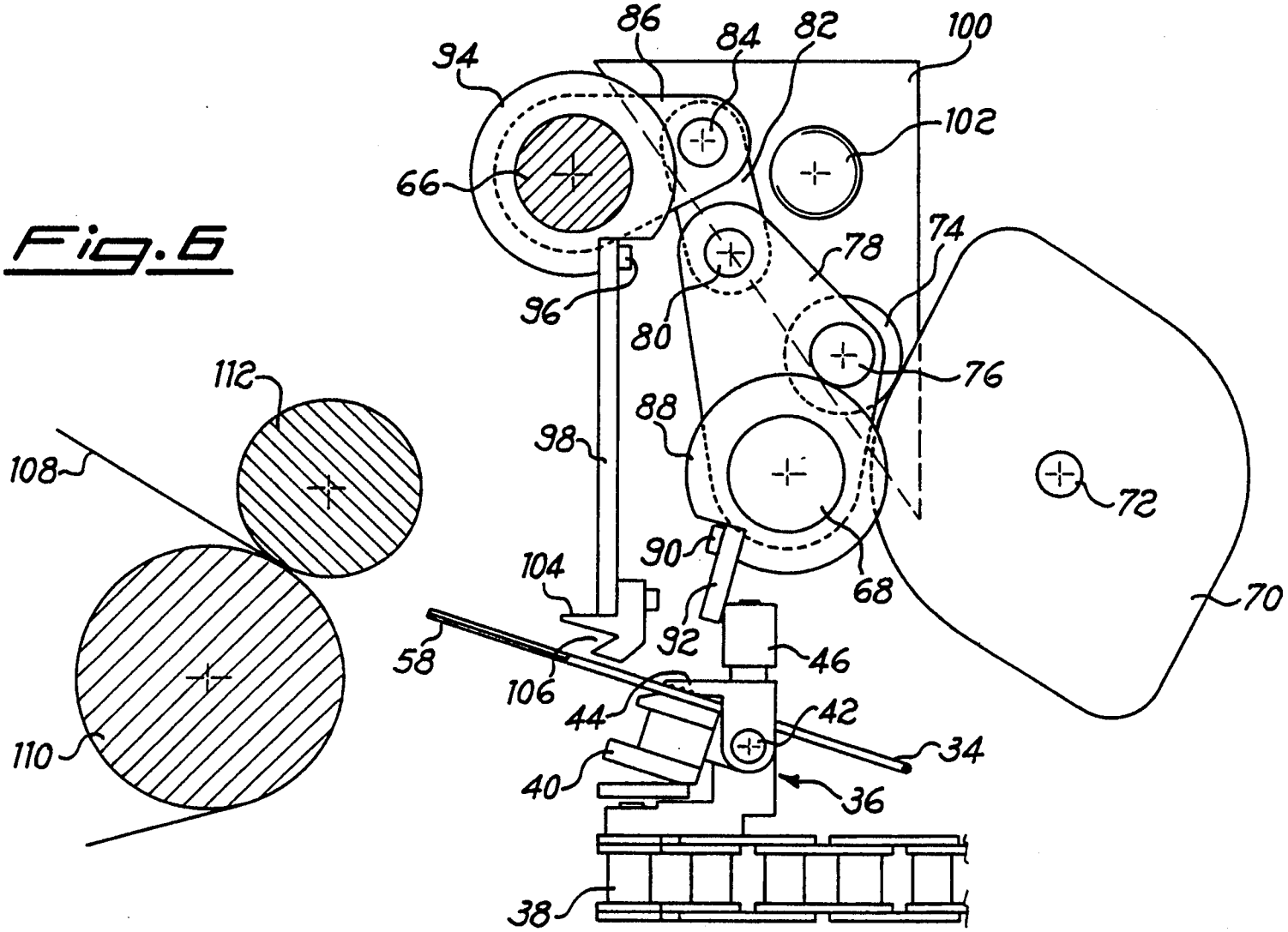
FIG. 6 is a side view showing as a whole the mechanisms for controlling handle motion as well as those for transferring the handles to the bag forming station; said mechanisms are not represented in FIG. 1 for the sake of clearness and are respectively arranged in the zones indicated by the areas A and B in the same figure.
Figure 7:
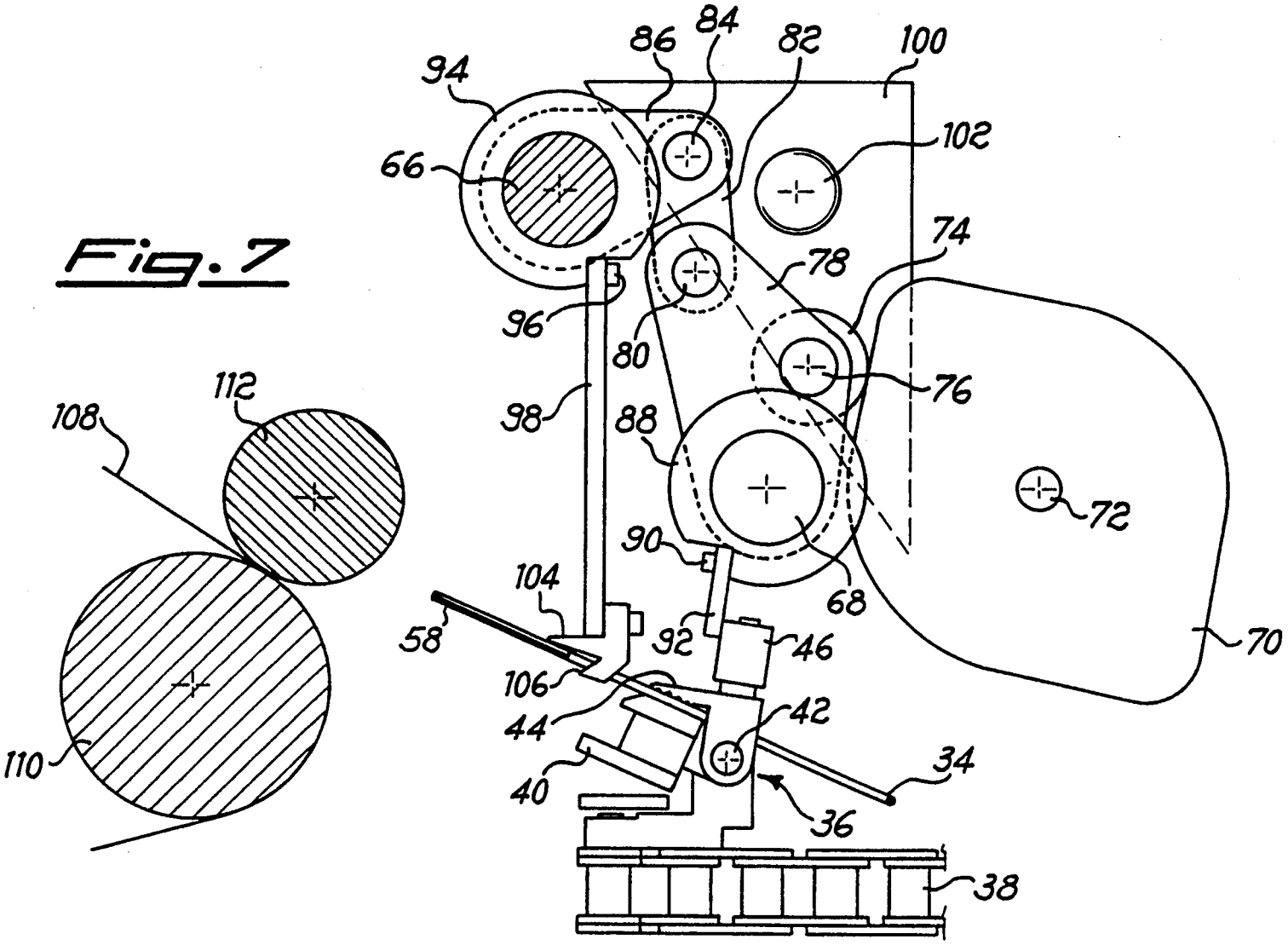
FIG. 7 is a view similar to FIG. 6 showing the above mentioned mechanisms in an operating step successive to that of FIG. 6.
Figure 8:
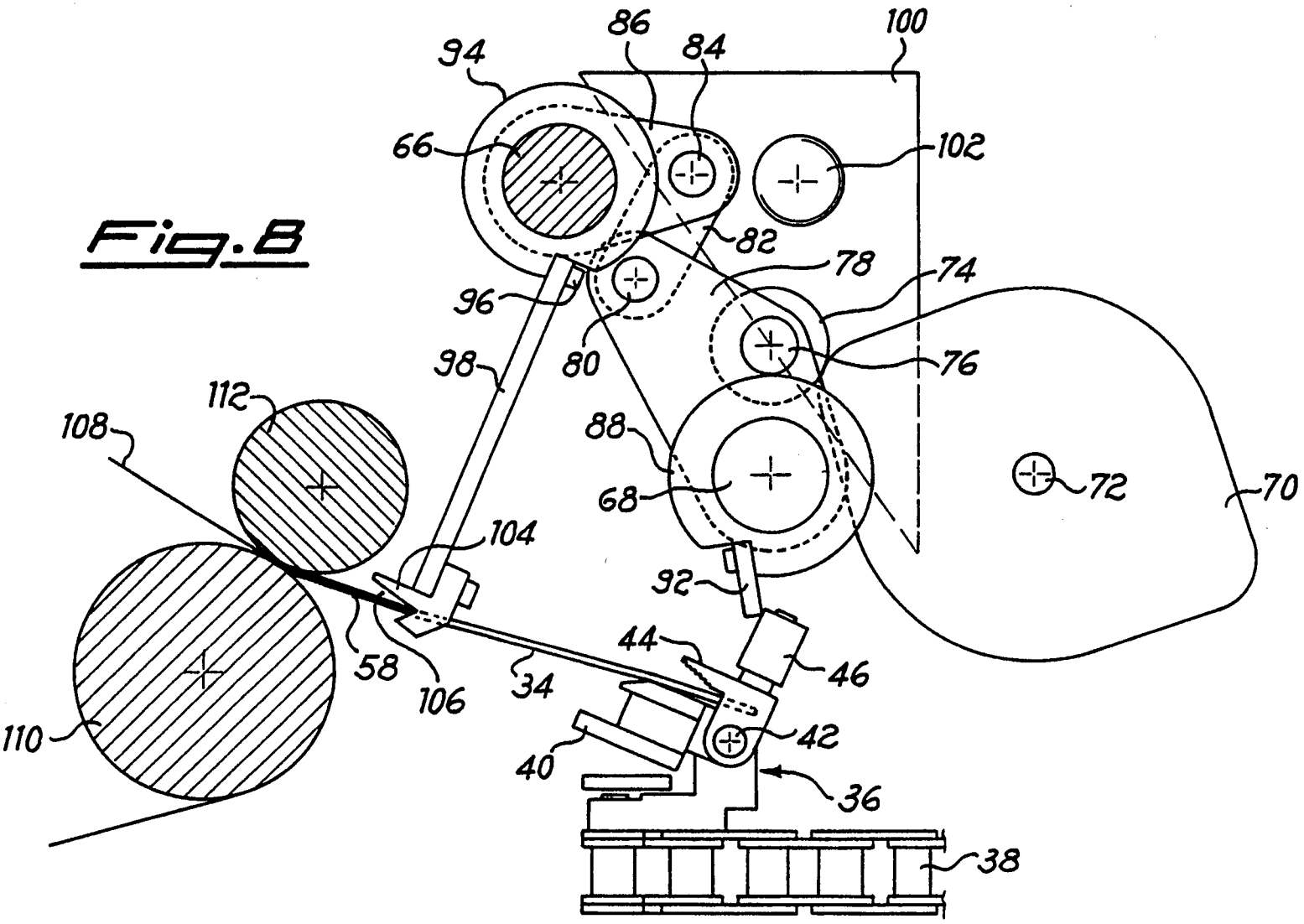
FIG. 8 is a view similar to FIG. 7 showing the above mentioned mechanisms in an operating step successive to that represented in FIG. 7.

It must be appreciated that in FIGS. 6 to 8 either the means located in the section A has been represented or the one of section B in FIG. 1 but their actual position will be clear from the function they perform with relation to pliers 36 or handles 34.

In this part of the apparatus two main driving shafts 66 and 68 are provided extending parallel to each other as well as parallel to the advancing direction of pliers 36 along the path during which the opening of pliers 36 and the taking of handles 34 take place. In FIG. 1, for the sake of illustrative clearness, only the driving shaft 66 has been represented and in said drawing there is seen that it extends, like the shaft 68 although not represented, for all the apparatus length.

Now there will be described at first the driving means located in the position indicated by section A in FIG. 1.

Said means comprises a rotatable driving cam 70 having two curvilinear protruding portions substantially diametrically opposed, which is keyed on a rotating shaft 72 on the apparatus casing and connected to a not represented driving motor.

The cam 70 engages with an idle roller 74 rotating on a supporting pin 76 which is fixed, at one end thereof, in correspondence with the vertex of a first lever 78 having a substantially triangular shape, another vertex of which is fixed on the driving shaft 68.

On the remaining vertex of the first lever 78 a pin 80 is fixed on which the end is pivoted of a connecting rod 82 whose other end is pivoted on a pin 84 fixed on one end of a second lever 86 whose other end is keyed on the shaft 66.

Now the means will be described located in the position indicated by section B of FIG. 1 as well as the one intended to take handle 34 from plier 36 and to feed it to the forming station of bags which are shown in FIG. 1.

The means located in the position indicated by section B in FIG. 1 is intended to control the opening of plier 36 while this advances leftwards in FIG. 1 for the part **12*b* and it is formed by a sleeve 88 fixed on the shaft 68 so as to rotate therewith. The sleeve 88 is nevertheless connected to the shaft 68 by non represented known means which allows its motion on said shaft depending on the position in which handle 34 will have to be applied. In other words the motion of sleeve 88, which will have to take place at the same time and with the same extent of means for taking handle 34, implies an advanced or delayed opening of pliers 36**.

The sleeve 88 is provided with a recess to which a small arm 92 is applied, by means of a screw 90, suitable to engage with roller 46 of plier 36.

The means accomplishing the taking of handle 34 and the feeding thereof to the bag forming station comprises a sleeve 94 fixed on the shaft 66 which is provided with a recess in which, by means of screws 96, a pair of small arms 98 is fixed extending downwards to the plier 36 and substantially parallel to each other. Also sleeve 94, as already said for sleeve 88, is connected to shaft 66 so that it may be moved thereon and kept in different positions for the hereinabove described reasons as it will be explained in the following.

A possible arrangement to obtain the movement of sleeves 88 and 94 on the shafts 68 and 66 schematically represented in FIGS. 6 to 8 and essentially consists of a plate 100 supported by a threaded shaft 102, rotatably substained at its ends by the apparatus casing, which screws itself into a threaded hole of plate 100 so that the revolutions of said threaded shaft 102 are transformed in transverse shiftings of plate 100.

In FIGS. 6 to 8 in particular there is seen that each of the small arms 98 is provided, at its lower end, with a shaped appendix 104 having a notch 106 with a shape, in transverse section, essentially triangular whose mouth is directed towards sheets 58 of handles 34.

The paper bag forming station is known thus it is not represented. Only the paper strip 108 thereof is shown from which bags will be obtained, that winds itself round a return roller 110 with which a pressing roller 112 cooperates, the strip 108 sliding through two said rollers.

The roller 112, cooperating with roller 110 exerts on the strip 108 the necessary pressure to accomplish a perfect adherence of sheets 58 on strip 108 and therefore a firm application of handles 34.

Figure 9:
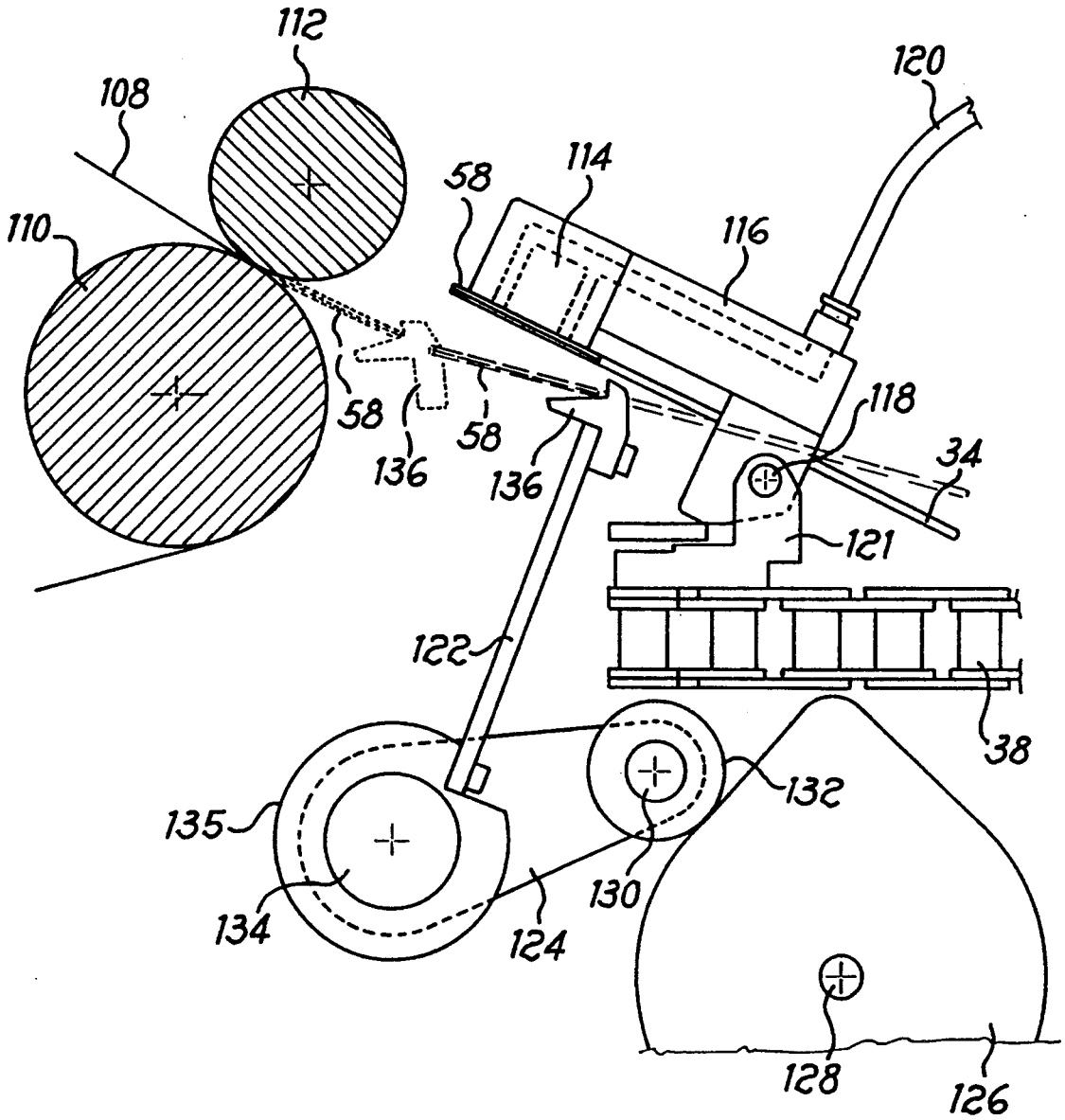
FIG. 9 is a schematic side view substantially corresponding to FIG. 6 and showing a different implementation of the mechanism for controlling the means for transporting handles to the bag forming station.

In FIG. 9 there is illustrated a different realization of means supporting and carrying handles 34 and, according to such a realization, they consist of a sucker 114 supported by a casing 116 pivoted at 118 on a body 121 integral with chain 38.

The sucker 114 is connected through a flexible pipe 120 to a non represented air suction station suitable to keep constant the drop of pressure inside sucker 114 when required.

The means for taking handles 34 and carrying them from sucker 114 to the bag forming station is substantially identical to the one of the previous realization.

As there is seen from FIG. 9 also in this case a pair of small arms 122 is provided extending upwards and fixed, with their lower end, to a sleeve 135 movably mounted on a shaft 134 rotatable on the apparatus casing. On shaft 134 the end of a lever 124 is fixed which is actuated by a rotatable cam 126. The cam 126 is keyed on a shaft 128 supported in any not represented known way by the apparatus casing, and connected to a control motor.

On one end of the oscillating lever 124 a pin 130 is applied on which a roller 132 is rotatably arranged which engages with cam 126.

Also in this case on the end of each of the small arms 122 a shaped appendix is provided having a notch 138 intended to engage with sheets 58 of handles 34.

Also in FIG. 9 the same elements of the paper bag forming station are shown as in FIGS. 6 to 8.

Now the operation of the apparatus according to the present invention will be described particularly relating to the operating steps of opening pliers 36 and feeding handles 34 to the bag forming station, as the taking of handles 34 by pliers 36 has been already hereinabove described referring in particular to FIGS. 2 to 5. The same should be considered for the operating step of applying glue on sheets 58 of handles 34 as also this step has been previously described referring to FIG. 1. Thus now there will be considered in particular FIGS. 6 to 8 being the most significant about this matter.

There is assumed to start from the condition in FIG. 6 which may be considered the normal position for the driving parts, in which cam 70, although in contact with roller 74, does not exert any pushing action thereon to cause the motion of the above described kinematic mechanism.

The cam 70, which is always rotating being connected to the apparatus driving means through shaft 72, moves from the position in FIG. 6 to that in FIG. 7, causing the engaging of its portion having greater bending radius with roller 74 and thus it will exert a pushing action on the latter causing an anti-clockwise rotation of the first lever 78, this rotation being allowed thanks to shaft 68 which is freely rotating on the apparatus casing.

While cam 70 proceeds with its rotation the mechanism reaches the condition represented in FIG. 7 in which small arm 92 of sleeve 88 has driven a complete rotation of the whole plier 36 around pin 42. The plier 36 is held in this close condition by means of the above mentioned non represented helical spring wound on pin 42.

In FIG. 7 there is seen that this initial rotation of plier 36 caused a corresponding rotation of handles 34 whose sheets 58 moved in correspondence of notch 106 of appendix 104 of small arms 98.

The rotation of cam 70 continues until this engages its portion having greater bending radius with roller 74 and this further rotation brings the mechanism in the condition shown in FIG. 8.

In said figure there is seen that first lever 78 rotated further and its small arm 92 drove the opening of plier 36 with raising of upper jaw 44. The lower jaw 40 stayed in the position of FIG. 7, i.e. it rotated no more just to allow the opening of plier 36. This stopping of lower jaw 40 may be accomplished in any known way, e.g. by providing a catch on the support of jaws 40, 44 which prevents a further rotation of jaw 40.

The further rotation of first lever 78 caused also a further rotation of connecting rod 82 implying in turn a clockwise rotation of second lever 86 allowed by the free rotation of shaft 66 on the apparatus casing.

The rotation of second lever 86 implies the consequent rotation of small arms 98 so that their lower end, namely their appendix 104, engages with sheets 58 of handle 34 whose rear edge fits into notch 106 of appendix 104. Small arms 98 exert a forward pushing action on handles 34 so that, as shown in FIG. 8, their front edge slides between rollers 110 and 112 above paper strip 108. As the lower surface of sheets 58 is smeared with glue, the passage of said sheets between said rollers 110, 112 will automatically imply their glueing on strip 108.

After these operating steps cam 70 engages again with roller 74 with its portion having smaller bending radius so that the whole mechanism will gradually return in the position shown in FIG. 6. The operating cycle herein described repeats every time a plier 36, either in the part **12*b* or in the part 12*a* of the apparatus, positions itself in front of small arm 92 of sleeve 88 and in front of appendixes 104 of small arms 98**.

In FIG. 1 in particular two handles 34 have been shown applied on strip 108 intended to form respectively the left and right handle of a bag.

The above described operation with reference to pliers 36 should be considered substantially valid for the different realization in which suckers are employed. In this case the opening of pliers 36 to allow the taking of handles 34 is substituted by the interruption of air-suction in suckers 114 so that sheets 58 of handles 34 can move downwards and fit their rear edge in notch 138 of small arms 122. These will be later operated by cam 126 and caused to rotate until the position represented in broken line in which the front edge of sheets 58 begins to slide between rollers 110 and 112 for their glueing on strip 108 as previously described.

For this different realization it will not be necessary the arrangement of cam section 50 as in FIGS. 2 to 5 as pliers 36 are not employed and therefore their opening is not necessary. The several suckers 114, from time to time, will exert a sucking action on sheets 58 of handles 34 substantially in correspondence with the position in which the cam section 50 is arranged according to the first realization.

From the above the advantages of the apparatus according to the present invention are clear and the most important of them are summarized hereinafter.

Building simplicity and extremely reduced encumbrance of the apparatus as all the different operating stations are arranged in line and substantially all at the same height, for instance at man's height.

Easiness and readiness of the apparatus adjustment as when the distance between the application zones of handles 34 has to be changed just the moving of two sleeves is sufficient, namely sleeves 88 and 94, naturally either for part 12*b* or for part 12*a*, and this is easily accomplished by rotating the threaded shaft 102 which drives the corresponding movements of the two plates 100.

When instead the applying frequency of handles 34 on strip 108 has to be changed it will be sufficient to change the speed of chains 38 carrying pliers 36 or suckers 114 and also this adjustment is accomplished contemporaneously with the changing of the cutting pitch of bags in the forming station thereof.

Building simplicity of mechanisms intended to move handles 34 and this clearly implies a considerable reduction of the apparatus maintenance with respect to that necessary for the usual machines.

Finally it is clear that variations and/or modifications may be brought to the apparatus according to the present invention, without thereby exceeding the scope of protection of the invention itself.

I claim:

1. An apparatus for carrying rope handles for paper bags from a rope handle forming station to a paper bag forming station, said rope handle forming station feeding two rows of rope handles in a predetermined direction, the rope handles having U bent ends, wherein said rode handles are applied on a paper strip at an entrance of said paper bag forming station before forming the paper bags, the apparatus comprising:

a first and a second plurality of means for gripping the rope handles, said first plurality of gripping means and said second plurality of gripping means being arranged substantially side by side and laterally with respect to the feeding direction of the two rows of rope handles fed from said rope handle forming station;

supporting means for carrying said gripping means along an essentially close path, said path being rectilinear at least along a first tract adjacent to that in which the rope handles supported by said gripping means are fed towards the bag forming station entrance and along a second tract in which said rode handles move transversely with respect to the direction along which said rope handles are introduced in the bag forming station;

means for smearing a glue layer on a surface of sheets for holding the ends of the U bent rope of the rope handle provided in a median zone of said first tract;

means for inhibiting said means for gripping the rope handles provided along the second tract; and means for bringing the handles to the bag forming station.

2. The apparatus according to claim 1, wherein said gripping means comprises pliers carried by a transporting chain moving along an essentially rectangular path.

3. The apparatus according to claim 2, characterized in that said pliers comprise an upper jaw and a lower jaw connected by a pivot pin having an elastic means arranged thereon, wherein said pliers are kept in a closed position by said elastic means arranged on the pivot pin of the two jaws.

4. The apparatus according to claim 3, further comprising a cam for opening said pliers to allow the fitting therein of a rope handle.

5. The apparatus according to claim 4, wherein said cam engages with the pivot pin of the pliers; and further comprising:

stop means for preventing rotation of the lower jaw during opening of the pliers.

6. The apparatus according to claim 3, wherein the second tract is provided with a movable arm to engage with the pivot pin of the pliers to open the upper jaw of the plier, and further comprising stop means for preventing movement of the lower jaw of the pliers.

7. The apparatus according to claim 6, further comprising a sleeve for supporting said movable arm and a shaft, said shaft being rotatable on a casing of the apparatus, wherein said sleeve is adjustably positioned on said shaft.

8. The apparatus according to claim 7, further comprising a cam means for rotating said shaft and a driving lever having an end keyed on said shaft for operating on said shaft.

9. The apparatus according to claim 2, wherein the second tract further comprises a means for taking the rope handle from the pliers when the pliers is opened and feeding the rope handle to the bag forming station.

10. The apparatus according to claim 9, wherein the means for taking and feeding a rope handle to the bag forming station comprises:

a shaft rotatable on a casing of the apparatus, the shaft having an adjustable sleeve thereon;

a pair of arms fixed on an upper end of the sleeve; and a shaped appendix fixed on a lower end of the sleeve, the appendix having a notch directed towards the bag forming station for engaging with a rear edge of the sheets of the rope handle.

11. The apparatus according to claim 10, further comprising:

a first driving lever having a first end and a second end, for driving the shaft wherein the first end is keyed on the shaft;

a second driving lever; and a hinged rod connecting said second driving lever with the second end of the first driving lever.

12. The apparatus according to claim 9, wherein said means for taking the rope handles comprise suckers.

13. The apparatus according to claim 12, wherein the suckers are inhibited by said inhibiting means while moving transversely with respect to the direction of feeding of the rope handles to the bag forming station, and simultaneously said means for bringing said rope handles to said bag forming station is operated.

14. The apparatus according to claim 13, wherein said means for bringing the rope handles to the bag forming station comprises a sleeve having an upper end and a lower end, a pair of arms fixed on the lower end of the sleeve, and a shaft rotatable on a casing of the apparatus, wherein the sleeve is adjustable on the shaft.

15. The apparatus according to claim 14, further comprising a cam means connected to the shaft by a driving lever for rotating the shaft.

16. The apparatus according to claim 14, wherein said upper arms further comprise a shaped appendix at an upper end thereof, said appendix having a notch therein for engaging a rear edge of the sheets.

17. The apparatus according to claim 1, wherein the means for smearing a glue layer on the sheets of the rope handle is arranged below a plane along which the rope handles are fed toward the paper bag forming station.

* * * * *